US007909022B2

(12) United States Patent
Kato et al.

(10) Patent No.: US 7,909,022 B2
(45) Date of Patent: Mar. 22, 2011

(54) FUEL SUPPLY SYSTEM FOR BOAT AND OUTBOARD MOTOR

(75) Inventors: Masahiko Kato, Shizuoka (JP); Yoshiyuki Kadobayashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 176 days.

(21) Appl. No.: 12/473,293

(22) Filed: May 28, 2009

(65) Prior Publication Data

US 2010/0132664 A1 Jun. 3, 2010

(30) Foreign Application Priority Data

May 30, 2008 (JP) ..... 2008-142614

(51) Int. Cl.
*F02M 61/14* (2006.01)

(52) U.S. Cl. ..... 123/470; 123/469

(58) Field of Classification Search ..... 123/468, 123/469, 470, 471, 472
See application file for complete search history.

(56) References Cited

U.S. PATENT DOCUMENTS 4,211,191 A * 7/1980 Kawamura et al. ..... 123/470
4,378,761 A * 4/1983 Kawamura ..... 123/184.21
4,429,667 A * 2/1984 Kawamura ..... 123/184.21
5,829,402 A 11/1998 Takahashi et al.

FOREIGN PATENT DOCUMENTS

JP 09-088623 A 3/1997
JP 2001-140720 A 5/2001

OTHER PUBLICATIONS

Kato et al.; "Fuel Supply System for Boat and Outboard Motor"; U.S. Appl. No. 12/473,290, filed May 28, 2009.
Kato et al.; "Fuel Supply System for Boat and Outboard Motor"; U.S. Appl. No. 12/473,291, filed May 28, 2009.
Kato et al.; "Fuel Supply System for Boat and Outboard Motor"; U.S. Appl. No. 12/473,294, filed May 28, 2009.

* cited by examiner

*Primary Examiner* — Erick Solis
(74) *Attorney, Agent, or Firm* — Keating & Bennett, LLP

(57) ABSTRACT

A fuel supply system for a boat minimizes and prevents deterioration in combustion efficiency of the engine. The fuel supply system includes a throttle body that is connected to an engine and that supplies air to the engine, and an injector that injects fuel to the throttle body. The injector is configured to inject fuel to a direction opposite to an airflow direction in the throttle body.

20 Claims, 14 Drawing Sheets

FUEL SUPPLY SYSTEM FOR BOAT AND OUTBOARD MOTOR

BACKGROUND OF THE INVENTION

1. Field of the Invention

The present invention relates to a fuel supply system for a boat and an outboard motor, and specifically relates to a fuel supply system for a boat including a fuel injection device for injecting fuel into an intake passage and an outboard motor.

2. Description of the Related Art

Conventionally, a fuel supply system for a boat including a fuel injection device for injecting fuel into an intake passage is known (See, for example, JP-A-2001-140720 and JP-A-Hei 9-88623).

The fuel supply system for a boat described in JP-A-2001-140720 and JP-A-Hei 9-88623 is a fuel supply system for an outboard motor provided on a boat. In JP-A-2001-140720 and JP-A-Hei 9-88623, fuel is pumped up from a fuel tank mounted on a hull and reserved in a vapor separator tank. The fuel reserved in the vapor separator tank is supplied to a fuel injection device by a fuel supply pump. The fuel supply system for a boat described in JP-A-2001-140720 and JP-A-Hei 9-88623 includes a throttle body including a throttle valve for adjusting a flow rate of air supplied to an engine and an intake passage including a plurality of intake pipes, first ends of which are connected to the throttle body and the second ends of which are respectively connected to a plurality of cylinders. The fuel injection device is disposed in the vicinity of a combustion chamber and configured to inject fuel toward a direction in which the air in the intake passage flows (from upstream to downstream).

As in JP-A-2001-140720 and JP-A-Hei 9-88623, in the case where the fuel injection device is disposed in the vicinity of the combustion chamber, it is effective to inject fuel toward a direction of air flow in order to generate a swirl or a tumble in the combustion chamber.

However, in the case where the fuel injection device is spaced from the combustion chamber, if fuel is injected toward the direction in which the air in the intake passage flows, the fuel adheres to a wall surface of the intake passage. Accordingly, it is difficult to spread fuel evenly in the intake passage. Thus, there occurs an uneven distribution of air-fuel ratio in the air-fuel mixture, resulting in deterioration in combustion efficiency of the engine. Specifically, when the configuration in which fuel is injected toward the direction in which the air in the intake passage flows is applied to a configuration in which a single fuel injection device is provided to a plurality of intake pipes of an engine having a plurality of cylinders, the air-fuel ratio of the air-fuel mixture suctioned into each intake pipe fluctuates due to uneven distribution of the fuel, thereby fluctuating the air-fuel ratio of the air-fuel mixture supplied to each cylinder. As a result, it becomes difficult to supply an air-fuel mixture with an appropriate air-fuel ratio evenly to each cylinder, resulting in further deterioration in combustion efficiency of the engine.

SUMMARY OF THE INVENTION

In view of the above, preferred embodiments of the present invention provide a fuel supply system for a boat and an outboard motor that prevents deterioration in combustion efficiency of an engine.

A fuel supply system for a boat according to a first preferred embodiment of the present invention includes: an intake passage that is connected to an engine and is arranged to supply air to the engine; and a fuel injection device arranged to inject fuel to the intake passage. The fuel injection device is configured to inject fuel to a direction opposite to an airflow direction in the intake passage.

In the fuel supply system for a boat according to the first preferred embodiment, as described above, fuel is injected in a direction (from downstream to upstream) opposite to the airflow direction in the intake passage. Therefore, by colliding with air, the fuel can be atomized and distributed evenly in the air. This minimizes and prevents the occurrence of uneven distribution of the air-fuel ratio in the air-fuel mixture, thereby preventing deterioration in combustion efficiency of the engine. Specifically, in the case where this system is applied to the configuration in which a single fuel injection device is provided to a plurality of intake pipes of an engine having a plurality of cylinders, the single fuel injection device can inject and distribute fuel evenly to the plurality of intake pipes, thereby supplying a air-fuel mixture with the same air-fuel ratio to each of the plurality of cylinders. This prevents deterioration in combustion efficiency of the engine.

In the fuel supply system for a boat according to the first preferred embodiment, preferably, the intake passage includes a throttle body including a throttle valve arranged to adjust a flow rate of air supplied to the engine, and the fuel injection device is configured to inject fuel in the vicinity of the throttle body. With this configuration, fuel is injected in the vicinity of the throttle body where air flows fastest in the intake passage. This further facilitates fuel atomization and facilitates even distribution of fuel in the air.

In the configuration in which the fuel injection device injects fuel in the vicinity of the throttle body, preferably, the engine includes a plurality of cylinders and the intake passage further includes a plurality of intake pipes, first ends of which are connected to the throttle body and second ends of which are respectively connected the plurality of cylinders. With this configuration, when the engine has a plurality of cylinders, it is possible to introduce a air-fuel mixture into a plurality of intake pipes connected to the respective cylinders under the condition that fuel is injected and evenly distributed in the air in the throttle body. This minimizes and prevents fluctuation in the air-fuel ratio of the air-fuel mixture introduced to each intake pipe between the plurality of intake pipes. Thus, an air-fuel mixture in the same air-fuel ratio can be supplied to each of the cylinders. Therefore, deterioration in combustion efficiency of the engine can be prevented.

In this case, only a single fuel injection device is preferably provided and the single fuel injection device is connected to each of the plurality of intake pipes. With this configuration, when the engine has a plurality of cylinders, the single fuel injection device can supply an air-fuel mixture in an even air-fuel ratio to each of the cylinders. That is, there is no need to provide a plurality of fuel injection devices. Accordingly, there is no need to provide a delivery pipe for distributing fuel to the plurality of fuel injection devices when the plurality of fuel injection devices are used, thereby decreasing the number of components and reducing weight of the fuel supply system for a boat.

In the configuration in which the fuel injection device injects fuel in the vicinity of the throttle body, the fuel injection device is preferably located in a downstream vicinity in an airflow direction relative to the throttle valve of the throttle body. With this configuration, fuel can be injected into a portion where air flows fastest in the throttle body. This further facilitates fuel atomization and facilitates even distribution of fuel in the air.

In the configuration in which the fuel injection device injects fuel in the vicinity of the throttle body, the fuel injection device is preferably configured to inject fuel toward the throttle valve. With this configuration, the fuel that is injected and is not taken into the air does not hit an inner peripheral surface of the throttle body but hits the throttle valve. This prevents the injected fuel from adhering to the inner peripheral surface of the throttle body.

In this case, the throttle valve preferably includes a butterfly-type throttle valve. With this configuration, since there is a flow of air between the throttle valve and the inner peripheral surface of the throttle body, even if fuel adheres to the throttle valve, the adherent fuel can be taken into the flow of air when the adherent fuel moves to an end (an end on the side of the inner peripheral surface of the throttle body) of the throttle valve. Thus, differing from the case where fuel is injected toward the inner peripheral surface of the throttle body, a portion of the injected fuel can be prevented from adhering to the inner peripheral surface of the throttle body without being taken into the air.

In the configuration in which the fuel injection device injects fuel in the vicinity of the throttle body, preferably, the throttle body includes: a main air passage in which the throttle valve arranged to adjust a flow rate of air supplied to the engine is provided; and a bypass air passage that connects an upstream side and a downstream side of the main air passage relative to the throttle valve. The fuel injection device is disposed such that an injection nozzle of the fuel injection device is positioned in the vicinity of an air exit of the bypass air passage positioned downstream of the throttle valve. With this configuration, fuel can be injected into a portion where air flows relatively fast in the vicinity of the air exit of the bypass air passage. This further facilitates fuel atomization and facilitates even fuel distribution in the air.

In the configuration in which the fuel injection device injects fuel in the vicinity of the throttle body, preferably, the fuel supply system further includes: a fuel tank arranged to hold fuel to be supplied to the fuel injection device; and a fuel supply pump arranged to supply the fuel from the fuel tank to the fuel injection device. The fuel tank is disposed adjacent to the throttle body. With this configuration, the temperature of the throttle body is decreased by fuel vaporization when fuel is injected to the throttle body. Therefore, an increase in the temperature in the fuel tank can be minimized and prevented by arranging the fuel tank adjacent to the low-temperature throttle body. This prevents generation of vapor (vaporized fuel) in the fuel tank.

In the configuration in which the fuel injection device injects fuel in the vicinity of the throttle body, preferably, the throttle body includes a main air passage in which the throttle valve arranged to adjust a flow rate of air supplied to the engine is provided, and the fuel injection device is configured to inject fuel obliquely relative to the vertical direction on a plane that is perpendicular or substantially perpendicular to a direction in which the main air passage of the throttle body extends. With this configuration, the height of the top of the fuel injection device can be lowered compared with the case where the fuel injection device is configured to vertically inject fuel from just above. This makes it possible to provide a unit including the throttle body and the fuel injection device compact.

An outboard motor according to a second preferred embodiment of the present invention includes an engine, an intake passage that is connected to the engine and is arranged to supply air and a fuel injection device arranged to inject fuel to the intake passage, and the fuel injection device is configured to inject fuel to a direction opposite to an airflow direction in the intake passage.

In the outboard motor according to the second preferred embodiment, as described above, fuel is injected in a direction (from downstream to upstream) opposite to the airflow direction in the intake passage. Therefore, by colliding with air, the fuel can be atomized and distributed evenly in the air. This minimizes and prevents the occurrence of uneven distribution of the air-fuel ratio in the air-fuel mixture, thereby preventing deterioration in combustion efficiency of the engine. Specifically, in the case where this system is applied to the configuration in which a single fuel injection device is provided to a plurality of intake pipes of an engine having a plurality of cylinders, the single fuel injection device can inject and distribute fuel evenly to the plurality of intake pipes, thereby supplying a air-fuel mixture with the same air-fuel ratio to each of the plurality of cylinders. This prevents deterioration in combustion efficiency of the engine.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention are described below with reference to the accompanying drawings.

Figure 1:
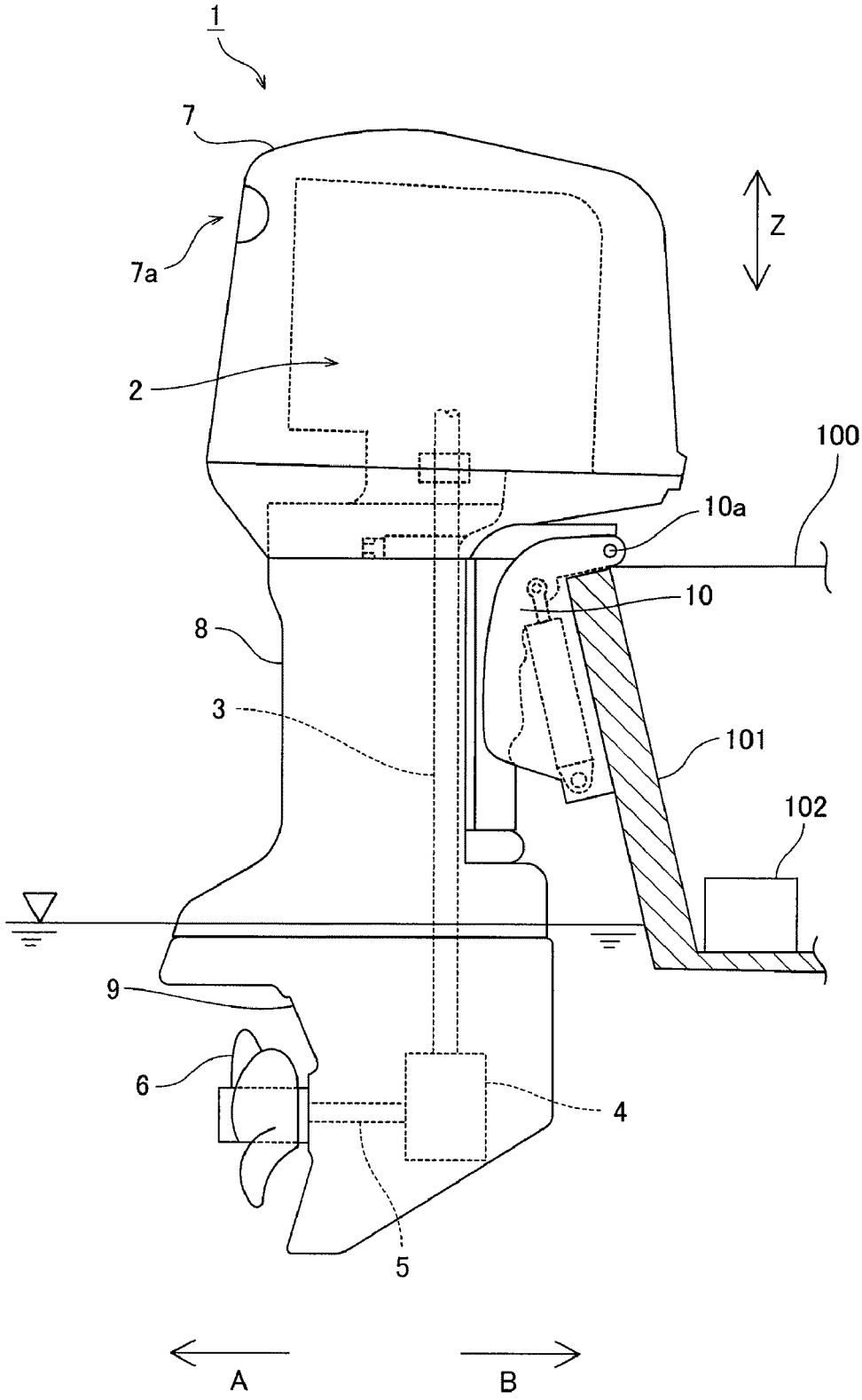
FIG. 1 is a side view showing a general construction of an outboard motor according to a preferred embodiment of the present invention.

FIG. 1 is a side view showing a configuration of an outboard motor that includes a fuel supply system for a boat according to a preferred embodiment of the present invention.

Figure 10:
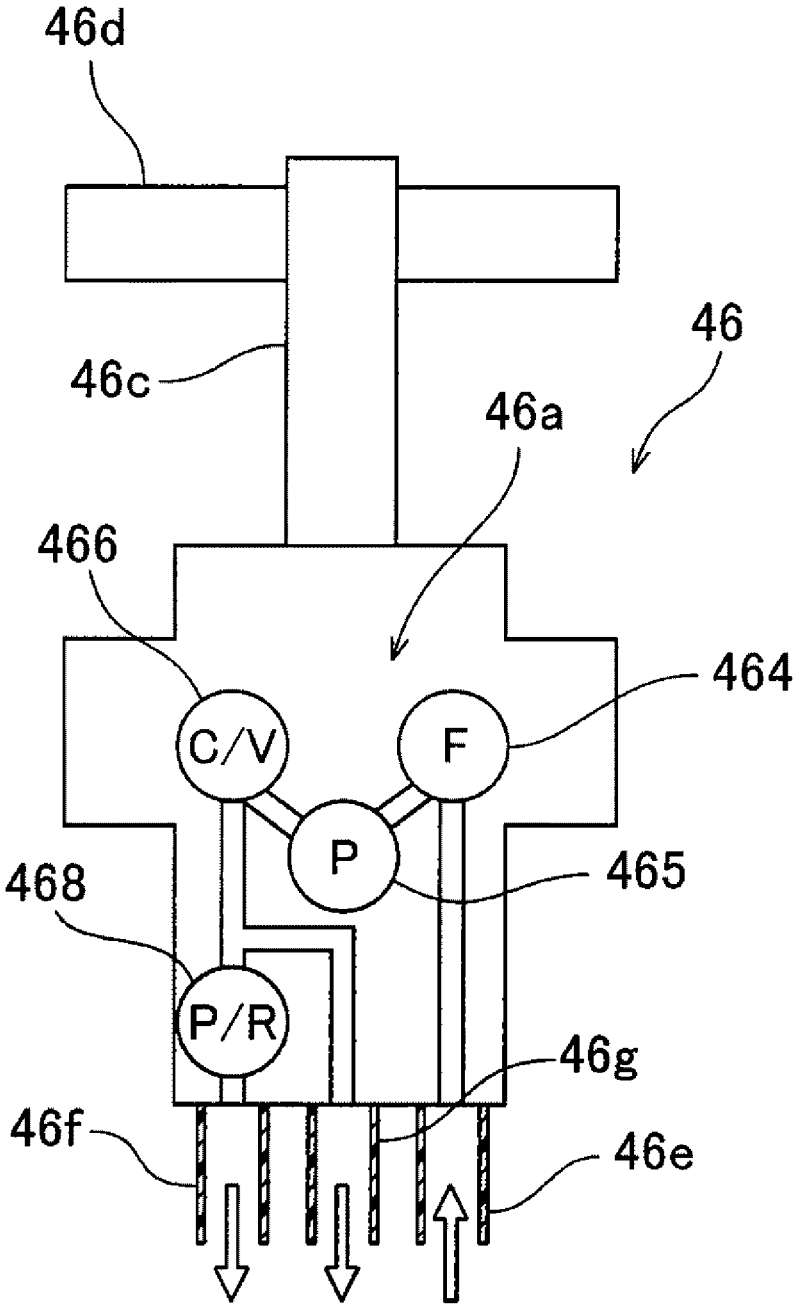
FIG. 10 is a schematic view showing the high-pressure fuel pump in the engine section of the outboard motor shown in FIG. 1.
Figure 11:
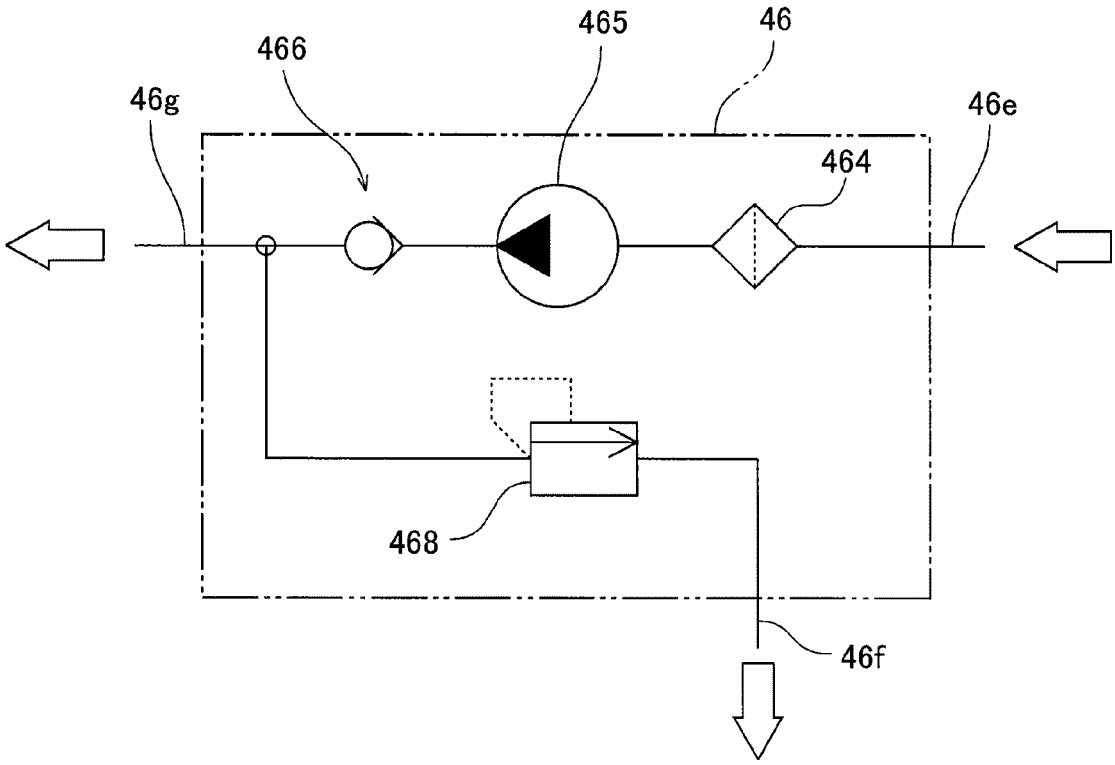
FIG. 11 is a hydraulic circuit diagram of the high-pressure fuel pump in the engine section of the outboard motor shown in FIG. 1.
Figure 12:
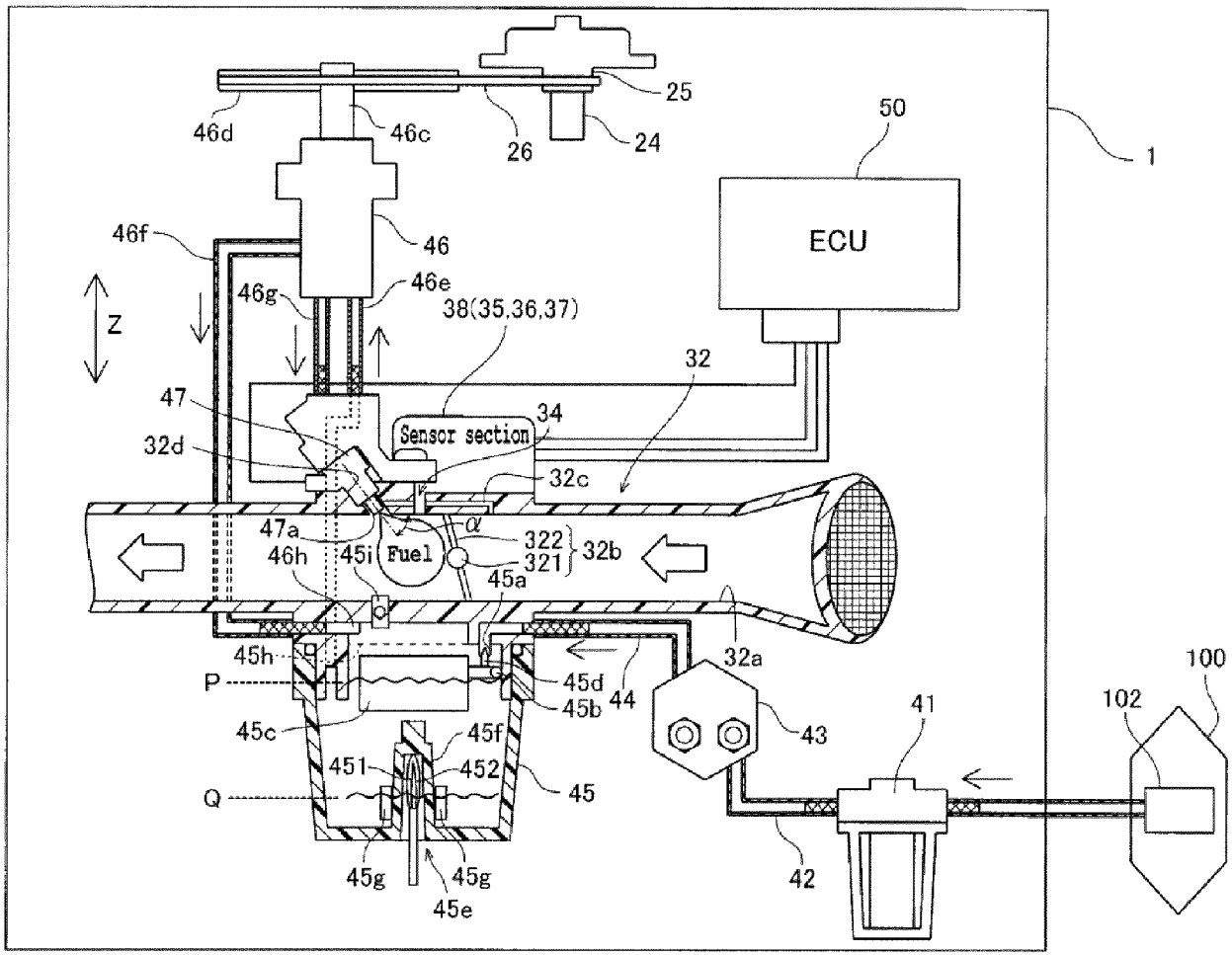
FIG. 12 is a schematic view showing a fuel supply system of the outboard motor of FIG. 1.

FIGS. 2 to 12 are illustrations showing the detailed structure of an engine of the outboard motor shown in FIG. 1. FIG. 12 is a schematic diagram showing functions of each component constituting the fuel supply system for a boat. The arrangement of each component (especially the location of a high-pressure fuel pump) in FIG. 12 is different from that in FIGS. 2 to 8. First, referring to FIGS. 1 to 12, a structure of an outboard motor 1 provided with a fuel supply system for a boat according to a preferred embodiment of the present invention will be described.

As shown in FIG. 1, the outboard motor 1 includes an engine section 2, a drive shaft 3 that is rotated by the driving force of the engine section 2 and extends vertically, a forward/reverse changing mechanism 4 connected to a lower end of the drive shaft 3, a propeller shaft 5 that is connected to the forward/reverse changing mechanism 4 and extends horizontally, and a propeller 6 attached to a rear end portion of the propeller shaft 5. The engine section 2 is housed in a cowling 7. In an upper case 8 and a lower case 9 arranged below the cowling 7, the drive shaft 3, the forward/reverse changing mechanism 4, and the propeller shaft 5 are housed. The outboard motor 1 is mounted to a transom plate 101 provided on a reverse direction (direction of an arrow "A") side of a hull 100 via a clamp bracket 10. The clamp bracket 10 supports the outboard motor 1 pivotally around a tilt shaft 10*a* in a vertical direction with respect to the hull 100. A fuel tank 102 for reserving fuel (gasoline) is provided on the hull 100. The fuel tank 102 and the engine section 2 of the outboard motor 1 are connected by a fuel pipe (not shown). The engine section 2 of the outboard motor 1 is driven using fuel supplied from the fuel tank 102. The propeller 6 is driven by the driving force of the engine section 2 and a rotational direction of the propeller 6 is changed by the forward/reverse changing mechanism 4, thereby propelling the hull 100 in a forward direction (direction of an arrow "B") or in a reverse direction (direction of the arrow "A"). A vent 7*a* is provided on a reverse direction (direction of the arrow "A") side portion of the cowling 7. Air supplied to the engine section 2 is taken in via the vent 7*a* into the engine section 2 in the cowling 7.

As shown in FIGS. 2 to 5, the engine section 2 includes an engine 20, an intake system 30 arranged to supply air to the engine 20, a fuel system 40 arranged to supply fuel to the engine 20, and an ECU (Engine Control Unit) 50 (see FIG. 12). The engine 20 is an example of the "engine" according to a preferred embodiment of the present invention.

Figure 2:
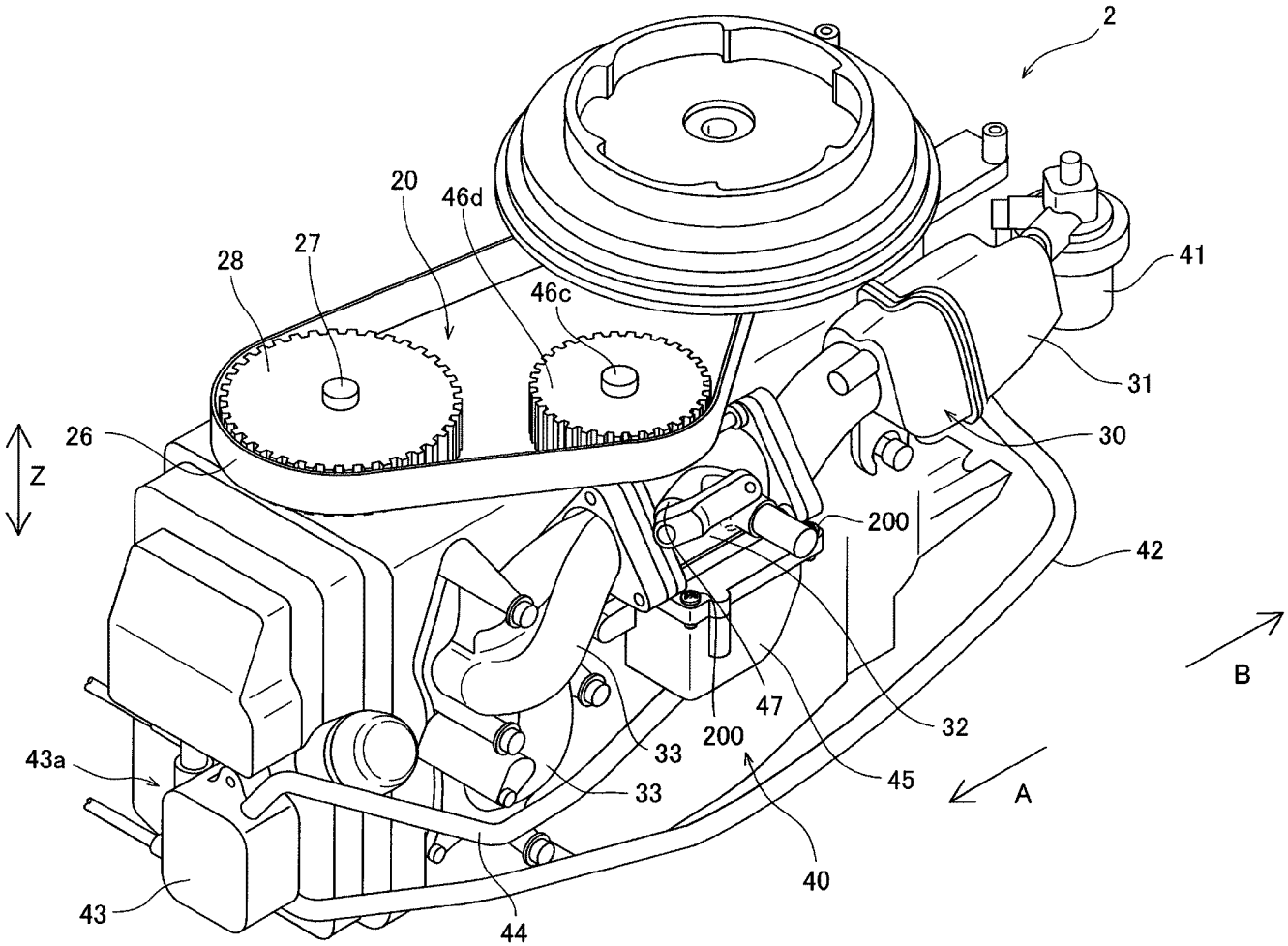
FIG. 2 is a perspective view showing an engine section of the outboard motor shown in FIG. 1.
Figure 3:
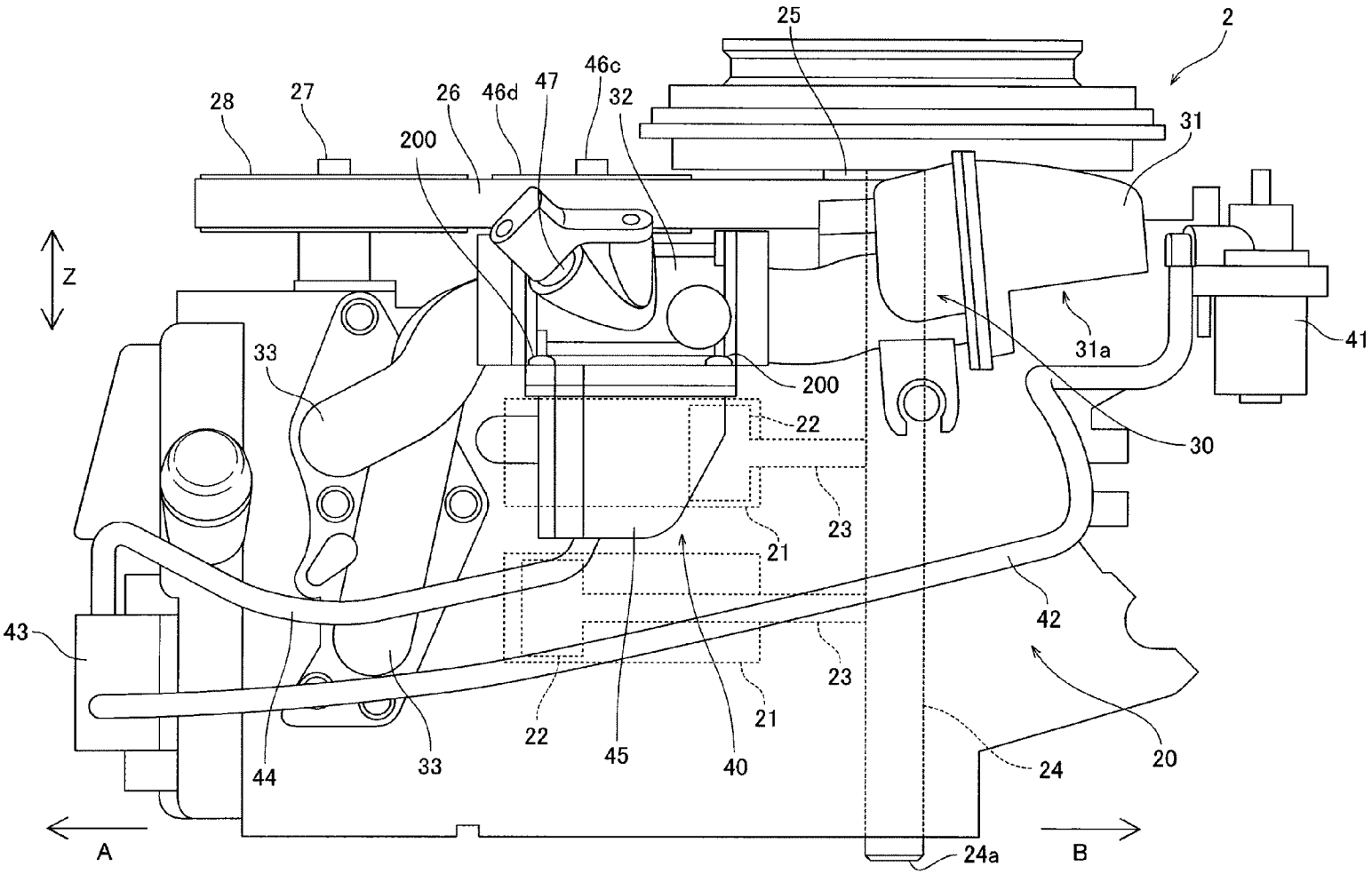
FIG. 3 is a side view showing the engine section of the outboard motor shown in FIG. 1.
Figure 4:
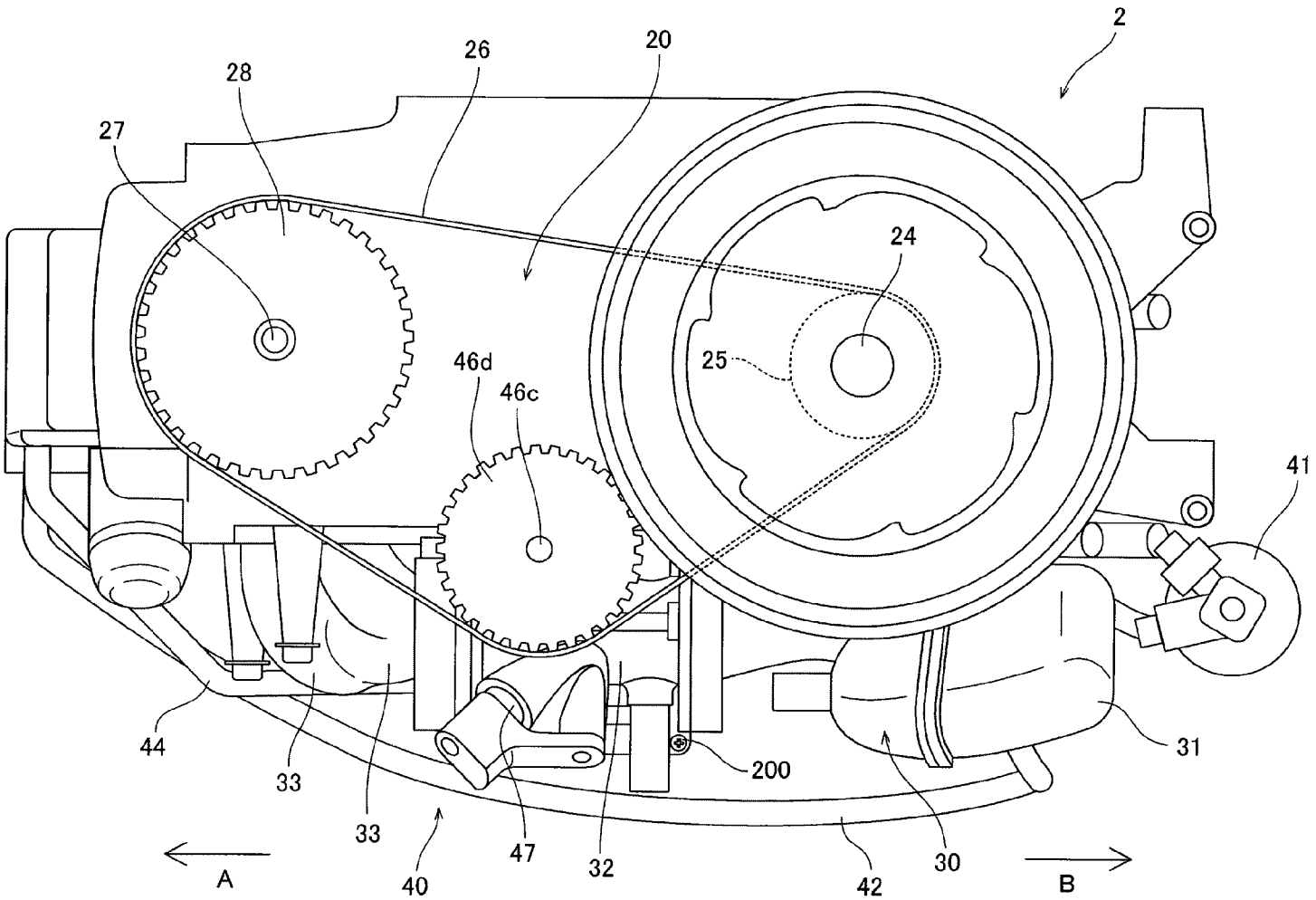
FIG. 4 is a top view showing the engine section of the outboard motor shown in FIG. 1.

As shown in FIG. 3, the engine 20 preferably includes two cylinders 21 disposed parallel or substantially parallel in a vertical direction ("Z" direction) and two pistons 22 respectively reciprocating horizontally in each of the cylinders 21. Each of the pistons 22 is connected to a crankshaft 24 extending in a vertical direction ("Z" direction) via a connecting rod 23. A horizontal reciprocating motion of the piston 22 is converted to a rotational motion by the connecting rod 23 and the crankshaft 24. A lower end 24*a* of the crankshaft 24 is connected to the drive shaft 3 (see FIG. 1). As shown in FIGS. 2 to 5, rotation of the crankshaft 24 is transmitted to a camshaft 27 by a pulley 25 fixed at the top of the crankshaft 24, a belt 26, and a pulley 28 fixed to the camshaft 27. An intake valve (not shown) and an exhaust valve (not shown) of each cylinder 21 are driven at predetermined timings by the rotation of the camshaft 27.

Figure 5:
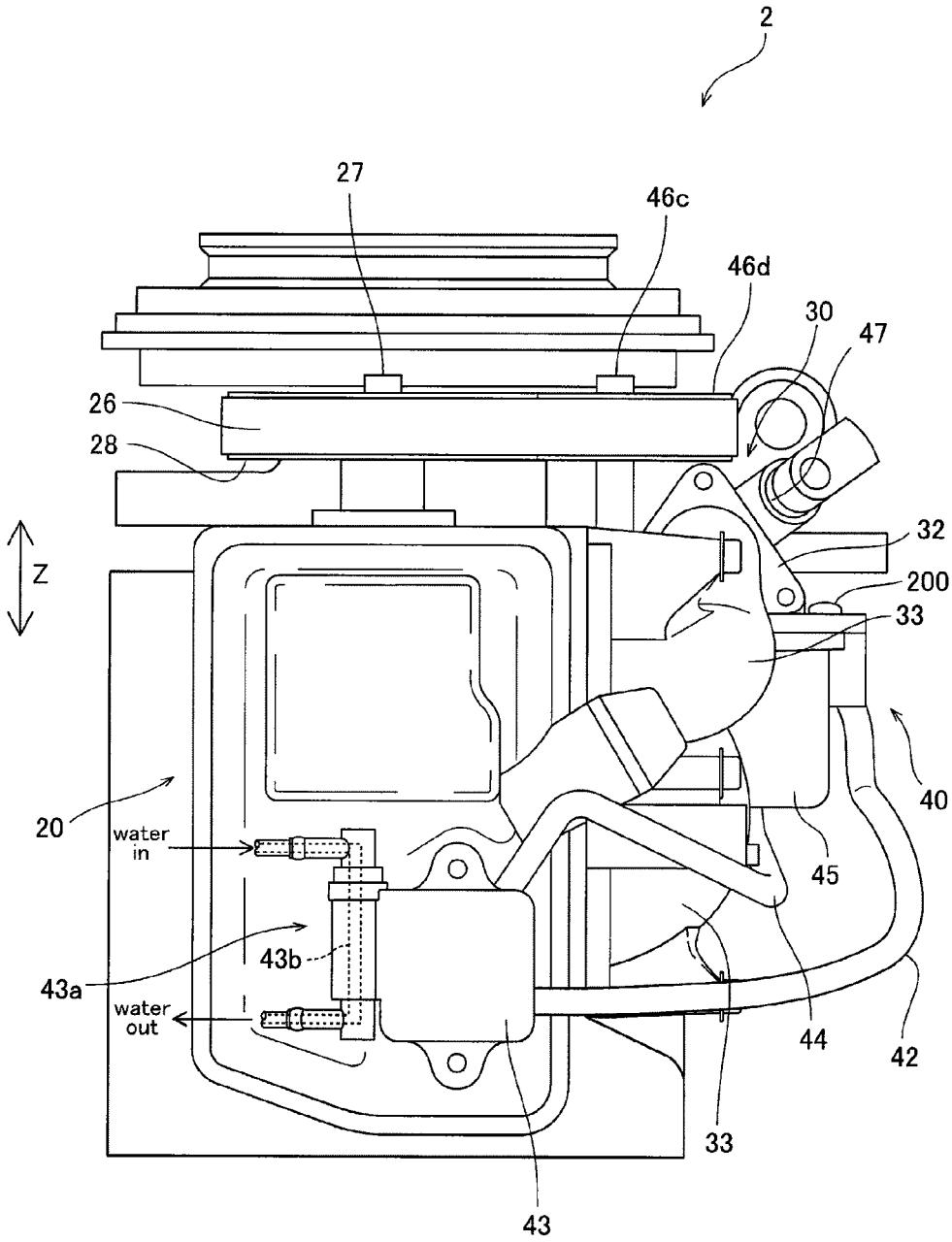
FIG. 5 is a front view showing the engine section of the outboard motor shown in FIG. 1.

As shown in FIGS. 2 and 5, the intake system 30 is disposed along a right side of the engine 20 when seen in a forward direction (direction of the arrow "B") of the engine 20. The intake system 30 includes a silencer case 31 that is disposed in a forward direction (direction of the arrow "B") side and has an inlet 31*a* (see FIG. 3), a throttle body 32 connected to the silencer case 31, and two intake pipes 33 respectively connected to an intake port (not shown) of each of the two cylinders 21 of the engine 20. Note that the silencer case 31, the throttle body 32, and the intake pipes 33 constitutes an example of the "intake passage" according to a preferred embodiment of the present invention.

As shown in FIGS. 6 to 8 and FIG. 12, the throttle body 32 is preferably formed of resin or metal and has a cylindrical air passage 32*a*. Note that the air passage 32*a* is an example of the "main air passage" according to a preferred embodiment of the present invention. A butterfly-type throttle valve 32*b* (see FIGS. 8 and 12) is provided in the air passage 32*a*. The butterfly-type throttle valve 32*b* includes a rotational shaft 321 extending perpendicular or substantially perpendicular to the air passage 32*a* and extending horizontally and a discoid valve plate 322 attached to the rotational shaft 321. When the valve plate 322 is generally vertical, the air passage 32*a* is fully closed by the valve plate 322. When the valve plate 322 is generally horizontal, the air passage 32*a* is fully opened. As shown in FIG. 12, a bypass air passage 32*c* that connects an upstream side and a downstream side of the air passage 32*a* relative to the throttle valve 32*b* is provided in the throttle body 32. The bypass air passage 32*c* provides an air flow rate at idling when the throttle valve 32*b* is completely closed. Also, in the bypass air passage 32*c*, an ISC (Idle Speed Control) unit 34 having a valve arranged to control the air flow rate in the bypass air passage 32*c* is provided. Engine speed at idling can be controlled by adjusting the opening degree of the valve of the ISC unit 34. The throttle body 32 also has a throttle opening sensor 35 arranged to detect the opening degree of the throttle valve 32*b*, an intake air pressure sensor 36 arranged to detect air pressure in the air passage 32*a*, and an intake air temperature sensor 37 arranged to detect air temperature in the air passage 32*a*. The ISC unit 34 and a sensor section 38 including the throttle opening sensor 35, the intake air pressure sensor 36, and the intake air temperature sensor 37 are attached to an upper portion of the throttle body 32.

As shown in FIGS. 2 to 6 and FIG. 12, the fuel system 40 includes a filter 41 connected to the fuel tank 102 disposed on the hull 100, a low-pressure fuel pump 43 connected to the filter 41 via a fuel pipe 42 preferably made of rubber or resin, a vapor separator tank 45 connected to the low-pressure fuel pump 43 via a fuel pipe 44 preferably made of rubber or resin, a high-pressure fuel pump 46 (see FIG. 6) arranged to transport fuel reserved in the vapor separator tank 45, and an injector 47 arranged to inject the fuel transported by the high-pressure fuel pump 46. Note that the vapor separator tank 45, the high-pressure fuel pump 46, and the injector 47 respectively are examples of the "fuel tank," the "fuel supply pump," and the "fuel injection device" according to a preferred embodiment of the present invention.

As shown in FIG. 5, the low-pressure fuel pump 43 preferably is a so-called diaphragm type fuel pump including a piston (not shown) and a diaphragm (not shown). The piston of the low-pressure fuel pump 43 is arranged to be reciprocated in conjunction with rotation of a cam (not shown) attached to the camshaft 27 of the engine 20 (see FIG. 2). The diaphragm is arranged to be reciprocated corresponding to the reciprocation of the piston, thereby transporting fuel. A water-cooling section 43*a* is provided on a side portion of the low-pressure fuel pump 43. The water-cooling section 43*a* has a pipe 43*b* extending along the side portion of the low-pressure fuel pump 43 and allows the pipe 43*b* to flow sea water, thereby cooling the low-pressure fuel pump 43. Since the fuel pumped up from the fuel tank 102 on the hull 100 by the low-pressure fuel pump 43 passes through the filter 41, foreign matters and the like contained in the fuel are eliminated.

Figure 6:
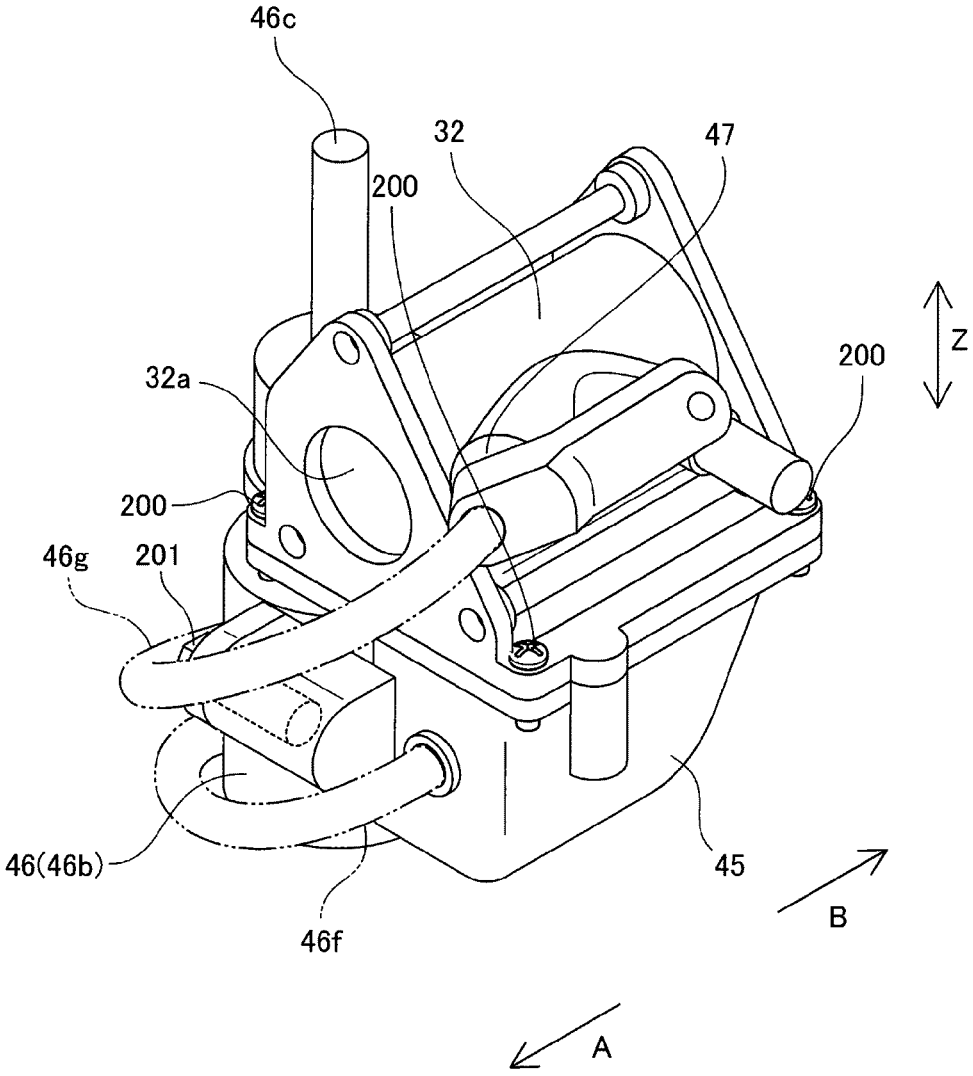
FIG. 6 is a perspective view showing a throttle body and its vicinity in the engine section of the outboard motor shown in FIG. 1.
Figure 7:
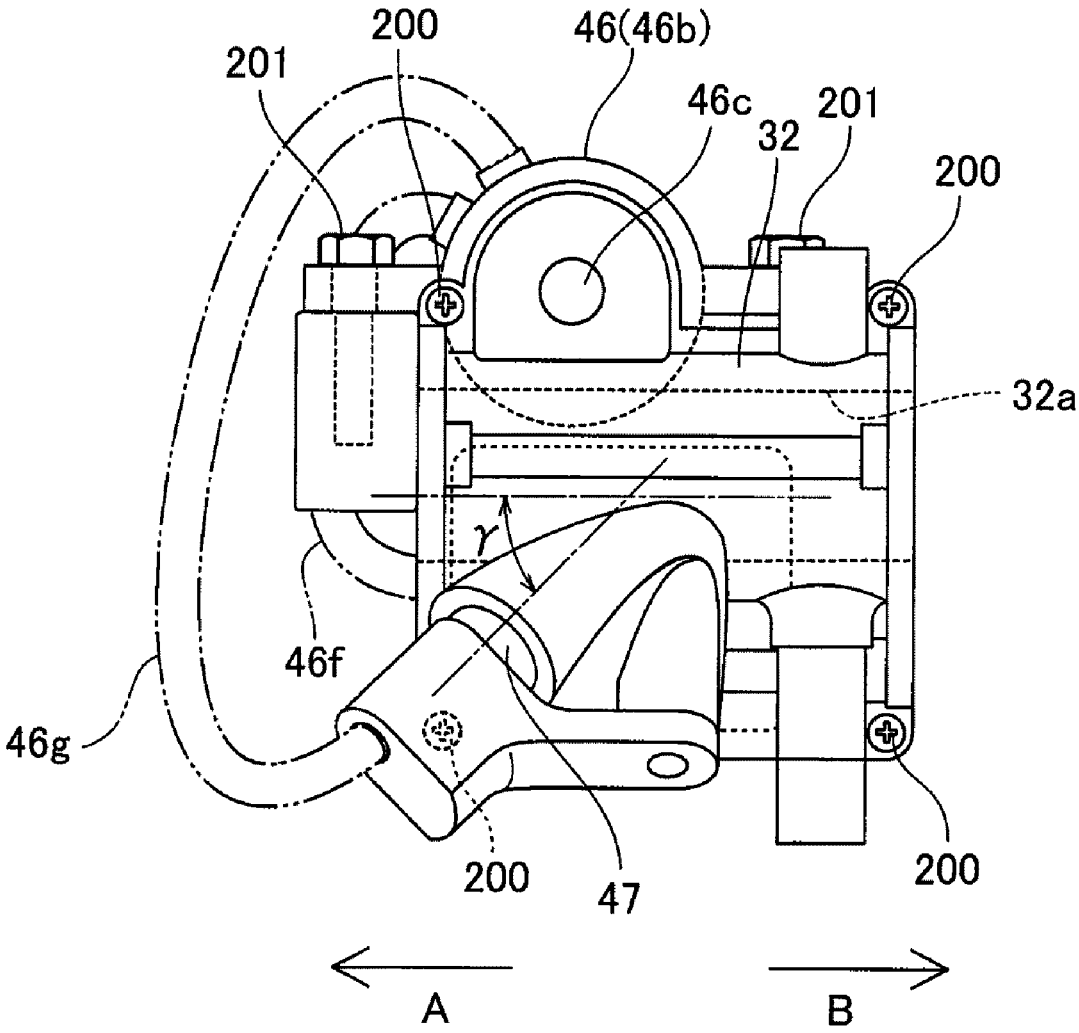
FIG. 7 is a top view showing the throttle body and its vicinity in the engine section of the outboard motor shown in FIG. 1.
Figure 8:
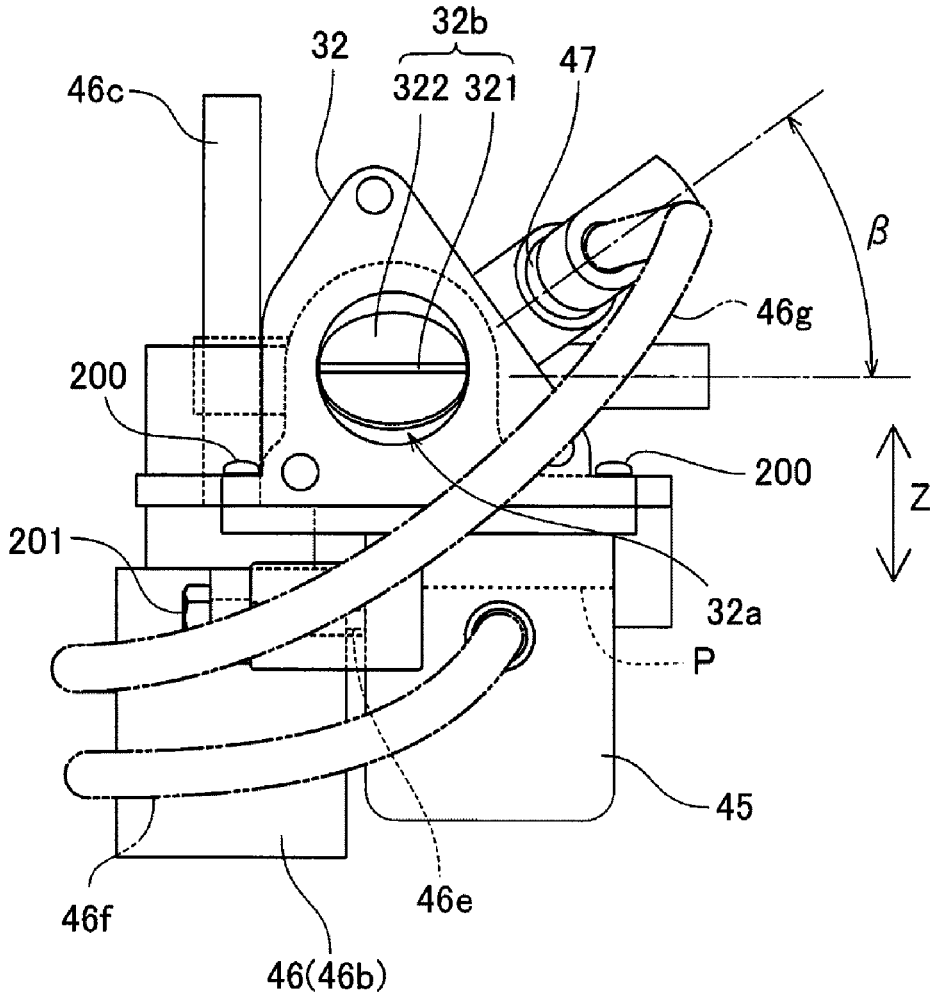
FIG. 8 is a front view showing the throttle body and its vicinity in the engine section of the outboard motor shown in FIG. 1.

The fuel sent out by the low-pressure fuel pump 43 via the fuel pipe 44 is discharged from an outlet 45*a* (see FIG. 12) into the vapor separator tank 45 to be reserved therein. The vapor separator tank 45 is preferably formed of resin and disposed adjacent to and below the throttle body 32 to contact with the throttle body 32. In this embodiment, as shown in FIGS. 6 to 8, the throttle body 32 and the vapor separator tank 45 are fixedly joined preferably by four screws 200, for example.

The vapor separator tank 45 reserves the fuel pumped up from the fuel tank 102 and separates the vaporized fuel (vapor) or air from the liquid fuel. As shown in FIG. 12, the vapor separator tank 45 is configured such that the reserved quantity of fuel in the tank is kept constant and the fuel in the tank is kept at a predetermined level "P." Specifically, a float 45*c* pivotable about a pivot shaft 45*b* in a vertical direction ("Z" direction) is provided in the vapor separator tank 45. A needle valve 45*d* is provided in the float 45*c* at a position corresponding to the outlet 45*a*. Since the float 45*c* moves in a vertical direction as the fuel level in the vapor separator tank 45 moves, the needle valve 45*d* moves in a vertical direction corresponding to the movement of the float 45*c*. If the fuel level in the vapor separator tank 45 becomes higher than the predetermined level "P," the float 45*c* ascends to insert the needle valve 45*d* into the outlet 45*a*, thereby automatically stopping inflow of fuel into the vapor separator tank 45. If the fuel level in the vapor separator tank 45 is lower than the predetermined level "P," the float 45*c* descends to separate the needle valve 45*d* from the outlet 45*a*, thereby automatically allowing inflow of fuel into the vapor separator tank 45. With the above described mechanism, the reserved quantity of fuel in the vapor separator tank 45 is kept constant and the fuel in the tank is kept at the predetermined level "P."

At the bottom of the vapor separator tank 45, there is provided a water sensor 45*e* arranged to detect water collected at the bottom of the vapor separator tank 45. Specifically, a central portion 45*f* of the bottom of the vapor separator tank 45 is protruded upward. The protruded portion defines a recess as seen from the outside below the vapor separator tank 45. Two leads 451, 452 are disposed in the recess and tips of the leads 451, 452 are connected. Also, a pair of floats 45*g* that are floatable in water are provided at the bottom of the vapor separator tank 45. Each of the pair of floats 45*g* has a built-in magnet (not shown). When water is collected in the bottom of the vapor separator tank 45, the float 45*g* having a magnet ascends as a water level "Q" ascends. When the floats 45*g* ascend up to a predetermined position, the tip of the lead 451 and the tip of the lead 452 are separated from each other by magnetic forces from the magnets. Accordingly, connection between the leads 451, 452 is interrupted. With the above configured water sensor 45*e*, it is possible to detect whether or not water is collected equal to or more than a predetermined quantity in the bottom of the vapor separator tank 45.

A leading end 46*h* of a pipe 46*f* is inserted into an upper portion of the vapor separator tank 45. The pipe 46*f* is connected to the high-pressure fuel pump 46, which will be described later. The fuel returned from the high-pressure fuel pump 46 is discharged from the leading end 46*h* of the pipe 46*f* into the vapor separator tank 45. A buffer plate 45*h* is disposed below the leading end 46*h* of the pipe 46*f* and above the float 45*c* in the vapor separator tank 45. A plurality of small holes are provided in the buffer plate 45*h*. Fuel is discharged from the leading end 46*h* of the pipe 46*f* via the holes of the buffer plate 45*h* into the vapor separator tank 45 to be reserved therein again. When the fuel discharged from the leading end 46*h* of the pipe 46*f* bubbles, the buffer plate 45*h* can drip the liquid fuel into the vapor separator tank 45 without dropping vapor.

The vapor separator tank 45 and the throttle body 32 are connected via a check valve 45*i*. The check valve 45*i* is configured to pass vapor (vaporized fuel) or air only in one direction from the vapor separator tank 45 to the throttle body 32. When vapor occurs to increase an internal pressure of the vapor separator tank 45, the check valve 45*i* opens to discharge the vapor from the vapor separator tank 45 to the throttle body 32. Also, when the engine (engine section 2) is operated, the negative pressure in the throttle body 32 opens the check valve 45*i* to discharge the vapor from the vapor separator tank 45 to the throttle body 32.

Figure 9:
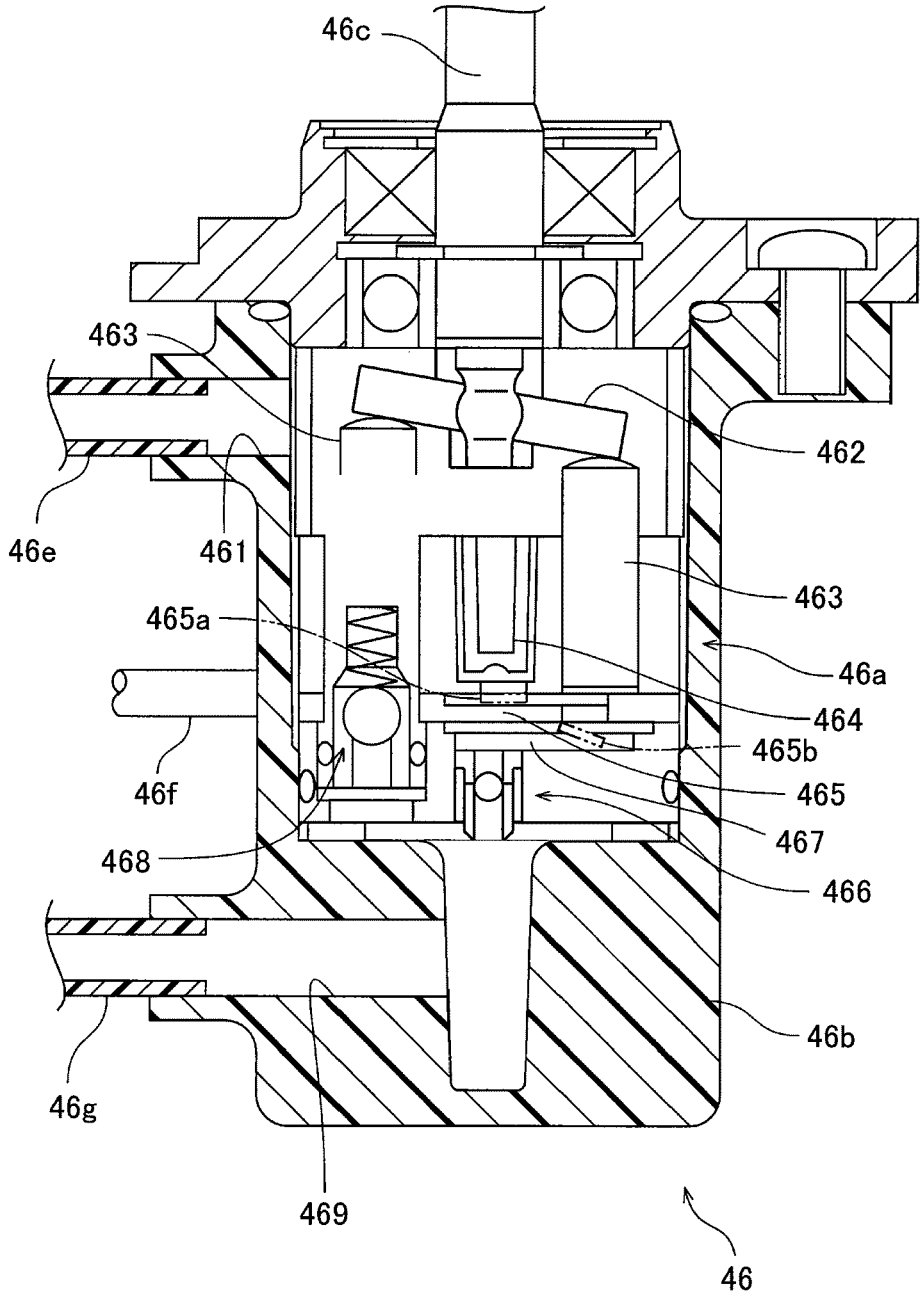
FIG. 9 is a partial sectional view showing the internal structure of a high-pressure fuel pump in the engine section of the outboard motor shown in FIG. 1.

As shown in FIGS. 6 to 8, the high-pressure fuel pump 46 is a so-called in-line type fuel pump that is disposed outside the vapor separator tank 45 and interposed between fuel pipes. The high-pressure fuel pump 46 is fixed to a side of the vapor separator tank 45 at two locations preferably by screws 201, for example. The high-pressure fuel pump 46 is preferably formed of resin as a base material. More specifically, as shown in FIG. 9, the high-pressure fuel pump 46 is configured such that a pump main portion 46*a* through which fuel passes is retained by an outer frame 46*b* preferably made of resin. The outer frame 46*b* is fixed to the vapor separator tank 45 preferably by screws 201 (see FIGS. 7 and 8), for example. The pump main portion 46*a* is configured to transport fuel by rotating a rotary shaft 46*c*. In this preferred embodiment, as shown in FIGS. 2 to 5, a pulley 46*d* is fixed at an upper end of the rotary shaft 46*c*. The pulley 46*d* is meshed with the belt 26 together with the pulley 25 of the crankshaft 24 and the pulley 28 of the camshaft 27. Thus, as the crankshaft 24 is rotated by the driving force of the engine 20, the pulley 46*d* and the rotary shaft 46*c* are rotated to drive the pump main portion 46*a*.

As shown in FIGS. 9 to 11, the pump main portion 46*a* preferably includes: an inlet 461 connected to the vapor separator tank 45 via a resinous pipe 46*e*; a swash plate 462 fixed aslant to the rotary shaft 46*c*; a plunger 463; a filter 464; a reserve chamber 465 arranged to temporarily hold reserve fuel; a reserve chamber 467 containing a fuel pressure retaining valve 466; a relief valve 468 connected to the vapor separator tank 45 via a resinous pipe 46*f*; and an outlet 469 connected to the injector 47 (see FIG. 12) via a resinous pipe 46*g*. An upper end of the plunger 463 abuts on a lower surface of the swash plate 462. As the swash plate 462 together with the rotary shaft 46*c* rotates, the plunger 463 moves in a vertical direction. When the plunger 463 moves upward, fuel is drawn from the vapor separator tank 45 into the reserve chamber 465 via the inlet 461 and the filter 464. When the plunger 463 moves downward, fuel is pushed out from the reserve chamber 465 to the reserve chamber 467. There are provided a lead valve 465*a* and a lead valve 465*b* respectively between the filter 464 and the reserve chamber 465 and between the reserve chamber 465 and the reserve chamber 467. These valves open when fuel flows in a transport direction (direction from the inlet 461 to the outlet 469) and close when fuel attempts to flow in the opposite direction. When fuel is drawn from the filter 464 into the reserving chamber 465, the lead valve 465*a* opens and the lead valve 465*b* closes at the same time as the plunger 463 moves upward. When fuel is pushed out from the reserving chamber 465 to the reserving chamber 467, the lead valve 465*a* closes and the lead valve 465*b* opens at the same time as the plunger 463 moves downward. When the pressure of the fuel reserved in the reserving chamber 467 becomes equal to or larger than a predetermined value, the fuel is discharged from the outlet 469 via the fuel pressure retaining valve 466. The outlet 469 is connected to the relief valve 468. When pressure at the outlet 469 excessively increases in such a case that the injector 47 (see FIG. 12) is plugged with fuel, fuel is discharged into the vapor separator tank 45 (see FIG. 12) via the relief valve 468 and the pipe 46*f*.

As shown in FIGS. 6 to 8 and 12, the injector 47 has a function to inject the fuel, which is sent out at a predetermined pressure by the high-pressure fuel pump 46, at the predetermined timing. In this preferred embodiment, the injector 47 is inserted into amounting hole 32*d* of the throttle body 32 for mounting. The injector 47 is configured to inject fuel in a direction (from downstream to upstream) opposite to an airflow direction in the air passage 32*a* of the throttle body 32. On a plane defined by the direction of fuel injection and the air flow direction, the direction of fuel injection is tilted at an angle of $\alpha$ (about 20 degrees to about 60 degrees, for example) relative to the airflow direction. Also, as shown in FIG. 8, on a plane perpendicular or substantially perpendicular to a direction in which the air passage 32*a* extends, the injector 47 is tilted upward at an angle of $\beta$ relative to the horizontal direction (direction in which the rotational shaft 321 of the throttle valve 32*b* extends) so as to inject fuel obliquely downward into the air passage 32*a* from above. Further, as shown in FIG. 7, on a horizontal plane, the injector 47 is tilted by an angle of $\gamma$ relative to the direction in which the air passage 32*a* extends. Thus, the injector 47 is disposed at angles (angle of $\alpha$, $\beta$, and $\gamma$) relative to the air passage 32*a*. Accordingly, the height of projection of the injector 47 from the throttle body 32 can be minimized, which makes it possible to provide a unit including the throttle body 32 and the injector 47 that is very compact. As shown in FIG. 12, an injection nozzle 47*a* of the injector 47 is disposed in a downstream vicinity of the throttle valve 32*b*. Fuel is injected from the injection nozzle 47*a* of the injector 47 toward the throttle valve 32*b*. Also, the injection nozzle 47*a* of the injector 47 is positioned at an exit of the bypass air passage 32*c*.

In this preferred embodiment, as described above, fuel is injected in a direction (from downstream to upstream) opposite to an airflow direction in the throttle body 32. Therefore, by colliding with air, the fuel can be atomized and distributed evenly in the air. This minimizes and prevents the occurrence of uneven distribution of the air-fuel ratio in the air-fuel mixture, thereby preventing deterioration in combustion efficiency of the engine 20.

In this preferred embodiment, as described above, the injector 47 is configured to inject fuel in the throttle body 32. Therefore, fuel is injected in the throttle body 32 where air flows fastest, which further facilitates fuel atomization and facilitates even fuel distribution in the air.

In this preferred embodiment, as described above, fuel is injected into the throttle body 32 under the condition that one end of each of the two intake pipes 33 is connected to the throttle body 32 and the other end of each of the two intake pipes 33 is connected to each of the two cylinders 21. Thus, the two intake pipes 33 respectively connected to the cylinders 21 can introduce an air-fuel mixture under the condition that fuel is injected and evenly distributed in the air in the throttle body 32. This prevents fluctuation in the air-fuel ratio of the air-fuel mixture introduced to each intake pipe 33 between the two intake pipes 33. Thus, an air-fuel mixture in the same air-fuel ratio can be supplied to each of the cylinders 21. Therefore, deterioration in combustion efficiency of the engine 20 can be prevented.

In this preferred embodiment, as described above, a single injector 47 is provided for and connected to the two intake pipes 33. Thus, the single injector 47 can supply an air-fuel mixture in an even air-fuel ratio to each of the cylinders 21 in the two-cylinder engine 20. That is, there is no need to provide a plurality of injectors. Accordingly, there is no need to provide a delivery pipe for distributing fuel to the plurality of injectors, thereby decreasing the number of components and reducing weight of the outboard motor 1.

In this preferred embodiment, as described above, the injector 47 is preferably disposed in a downstream vicinity in the airflow direction relative to the throttle valve 32*b* of the throttle body 32. Therefore, fuel can be injected into a portion where air flows fastest in the throttle body 32. This further facilitates fuel atomization and facilitates even distribution of fuel in the air.

In this preferred embodiment, as described above, the injector 47 is configured to inject fuel toward the throttle valve 32*b*. Therefore, the fuel that is injected and is not taken into the air does not hit an inner peripheral surface of the throttle body 32 but hits the throttle valve 32*b*. This prevents the injected fuel from adhering to the inner peripheral surface of the throttle body 32.

In this preferred embodiment, as described above, fuel is injected toward the butterfly-type throttle valve 32*b*. Accordingly, since there is a flow of air between the throttle valve 32*b* and the inner peripheral surface of the throttle body 32, even if fuel adheres on the throttle valve 32*b*, the adherent fuel can be taken into the flow of air when the adherent fuel moves to an end (an end on the side of the inner peripheral surface of the throttle body 32) of the throttle valve 32*b*. Thus, differing from the case where fuel is injected toward the inner peripheral surface of the throttle body 32, a portion of the injected fuel can be prevented from adhering to the inner peripheral surface of the throttle body 32 without being taken into the air.

In this preferred embodiment, as described above, the injection nozzle 47*a* of the injector 47 is preferably disposed in the vicinity of an air exit of the bypass air passage 32*c* positioned downstream of the throttle valve 32*b*. Therefore, fuel can be injected into a portion where air flows relatively fast in the vicinity of an air exit of the bypass air passage 32*c*. This further facilitates fuel atomization and facilitates even fuel distribution in the air.

In this preferred embodiment, as described above, the vapor separator tank 45 is disposed adjacent to the throttle body 32 whose temperature is decreased by fuel vaporization when fuel is injected thereto. Therefore, an increase in the temperature in the vapor separator tank 45 can be prevented by arranging the vapor separator tank 45 adjacent to the low-temperature throttle body 32. This easily minimizes and prevents generation of vapor (vaporized fuel) in the vapor separator tank 45.

In this preferred embodiment, as described above, the injector 47 is configured to obliquely inject fuel relative to the vertical direction on a plane that is perpendicular or substantially perpendicular to a direction in which the air passage 32*a* of the throttle body 32 extends. Therefore, the height of the top of the injector 47 can be lowered compared with the case where the injector 47 is configured to vertically inject fuel from just above the throttle body 32. This makes it possible to downsize a unit made up of the throttle body 32 and the injector 47.

It should be understood that the preferred embodiment described above is illustrative in all respects and not restrictive. The scope of the present invention is intended to be defined not by the above description of the above preferred embodiment but by the claims, and to include all equivalents and modifications of the claims.

For example, in the above preferred embodiment, the injector 47 is preferably disposed in the throttle body 32. However, the present invention is not limited thereto. The injector 47 may be disposed in the intake pipe 33. In this case, the number of the injectors is required to be the same as the number of the cylinder in the case of multi-cylinder engines.

In the above preferred embodiment, fuel is preferably injected toward upstream in a downstream side of the throttle valve 32*b*. However, the present invention is not limited thereto. Fuel may be injected to a direction opposite to an airflow direction in an upstream side of the throttle valve 32*b*.

In the above preferred embodiment, as shown in FIG. 8, the injector 47 is configured to inject fuel obliquely downward into the air passage 32*a* from above on a plane that is perpendicular or substantially perpendicular to a direction in which the air passage 32*a* extends. However, the present invention is not limited thereto. The injector 47 may be configured to inject fuel upward, laterally (horizontally), or downward into the air passage 32*a* on the plane orthogonal to a direction in which the air passage 32*a* extends.

In the above preferred embodiment, the butterfly-type throttle valve 32*b* is preferably used. However, the present invention is not limited thereto. A slide-type throttle valve may be used, for example.

In the above preferred embodiment, the direction of fuel injection is tilted at an angle of $\alpha$ (about 20 degrees to about 60 degrees, for example) relative to the airflow direction. However, the present invention is not limited thereto. The tilted angle $\alpha$ shown in FIG. 12 may be within the range between 0 to 90 degrees, for example.

In the above preferred embodiment, the high-pressure fuel pump 46 transports fuel preferably by driving the plunger 463 with the swash plate 462. However, the present invention is not limited thereto. Other types of high-pressure fuel pump such as a vane-type pump, a screw-type pump or a trochoid-type pump may be used.

In the above preferred embodiment, fuel is preferably gasoline. However, the present invention is not limited thereto. Fuel may be alcohol.

In the above preferred embodiment, the fuel supply system for a boat of the present invention is preferably applied to the outboard motor 1. However, the present invention is not limited thereto. The fuel supply system for a boat of the present invention may be applied to an inboard motor in which an engine section is mounted on a hull or to an inboard/outboard motor.

Figure 13:
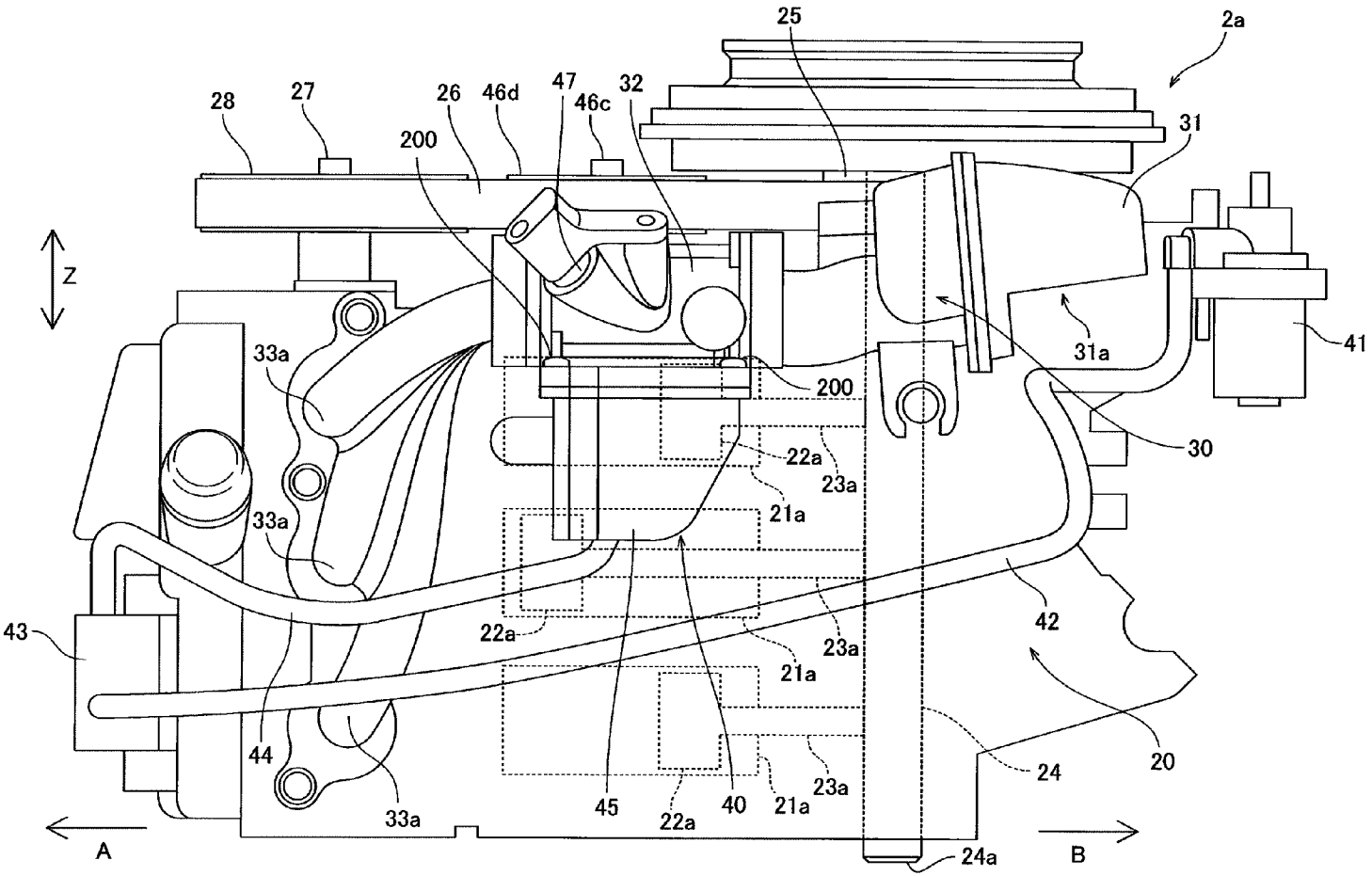
FIG. 13 is a side view of an engine section according to a variation of preferred embodiments of the present invention.
Figure 14:
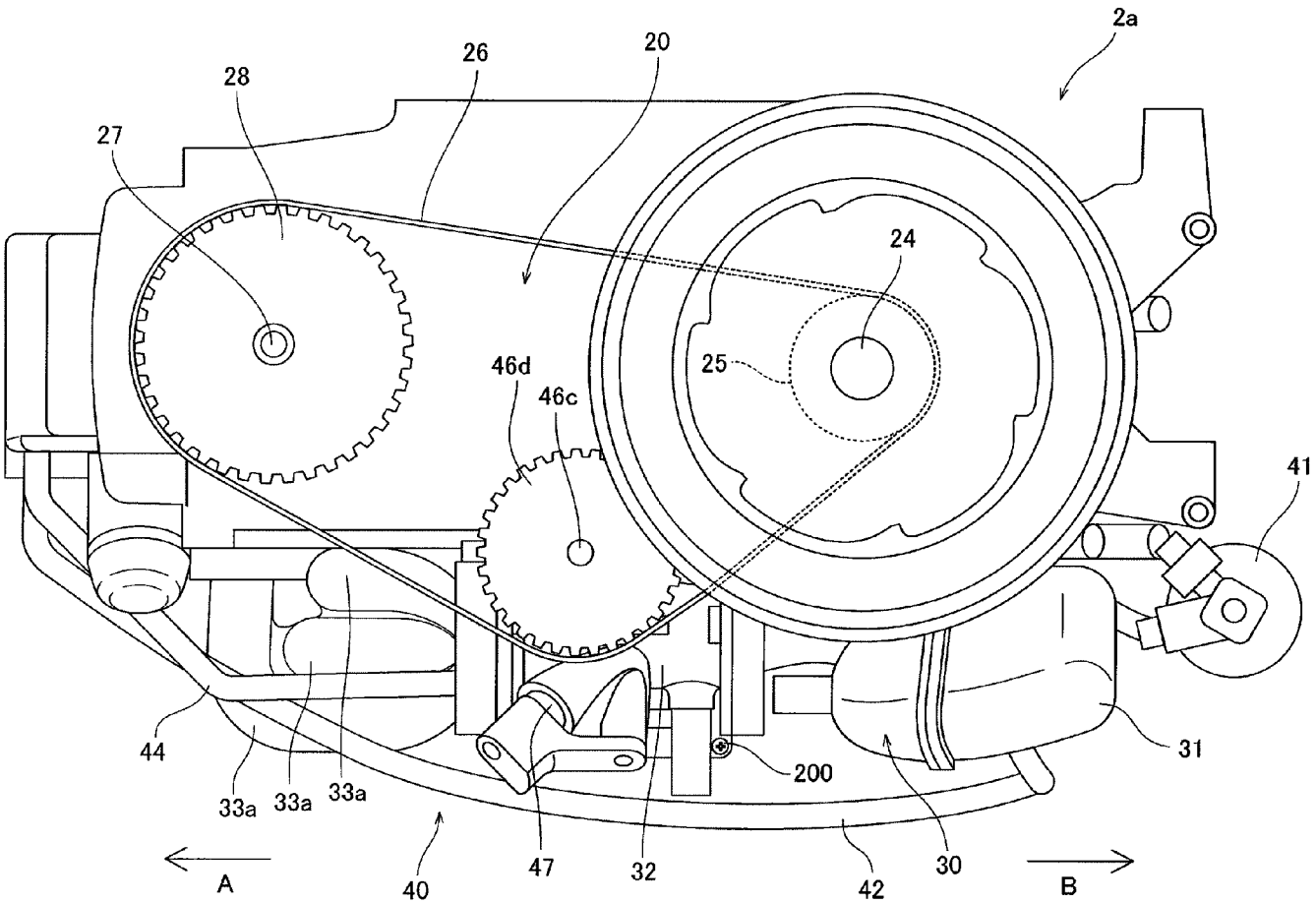
FIG. 14 is a plan view of the engine section according to the variation of preferred embodiments of the present invention.

In the above preferred embodiment, the present invention is preferably applied to the outboard motor 1 utilizing the two-cylinder engine section 2 having the two cylinders 21. However, the present invention is not limited thereto. The present invention may be applied to an outboard motor utilizing an engine section having one cylinder or three or more cylinders. For example, a three-cylinder engine section 2*a* according to a variation shown in FIGS. 13 and 14 includes three cylinders 21*a* each having a piston 22*a* and a connecting rod 23*a*. The engine section 2*a* is connected to the throttle body 32 and includes three intake pipes 33*a* respectively connected to an intake port (not shown) of each of the three cylinders 21*a*. The construction other than the above mentioned is preferably similar to that of the engine section 2 in the outboard motor 1.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fuel supply system for a boat, the fuel supply system comprising:

an intake passage connected to an engine and arranged to supply air to the engine; and a fuel injection device arranged to inject fuel into the intake passage; wherein the fuel injection device is arranged to inject fuel in a direction opposite to an airflow direction in the intake passage.

2. The fuel supply system for a boat according to claim 1, wherein the intake passage includes a throttle body including a throttle valve arranged to adjust a flow rate of air supplied to the engine, and the fuel injection device is arranged to inject fuel in a vicinity of the throttle body.

3. The fuel supply system for a boat according to claim 2, wherein the engine includes a plurality of cylinders, and the intake passage further includes a plurality of intake pipes, first ends of which are connected to the throttle body and second ends of which are respectively connected to each of the plurality of cylinders.

4. The fuel supply system for a boat according to claim 3, wherein the fuel injection device is the only fuel injection device provided, and the fuel injection device is connected to each of the plurality of intake pipes.

5. The fuel supply system for a boat according to claim 2, wherein the fuel injection device is disposed downstream in the airflow direction relative to the throttle valve of the throttle body.

6. The fuel supply system for a boat according to claim 2, wherein the fuel injection device is arranged to inject fuel toward the throttle valve.

7. The fuel supply system for a boat according to claim 6, wherein the throttle valve includes a butterfly-type throttle valve.

8. The fuel supply system for a boat according to claim 2, wherein the throttle body includes a main air passage in which the throttle valve is located, and a bypass air passage arranged to connect an upstream side and a downstream side of the main air passage relative to the throttle valve, and the fuel injection device is arranged such that an injection nozzle of the fuel injection device is positioned in a vicinity of an air exit of the bypass air passage positioned downstream of the throttle valve.

9. The fuel supply system for a boat according to claim 2, further comprising:

a fuel tank arranged to hold fuel to be supplied to the fuel injection device; and a fuel supply pump arranged to supply the fuel from the fuel tank to the fuel injection device; wherein the fuel tank is disposed adjacent to the throttle body.

10. The fuel supply system for a boat according to claim 2, wherein the throttle body includes a main air passage in which the throttle valve is provided, and the fuel injection device is arranged to inject fuel obliquely relative to a vertical plane that is perpendicular to a direction in which the main air passage of the throttle body extends.

11. An outboard motor comprising:

an engine;

an intake passage connected to the engine and arranged to supply air to the engine; and a fuel injection device arranged to inject fuel into the intake passage; wherein the fuel injection device is arranged to inject fuel in a direction opposite to an airflow direction in the intake passage.

12. The outboard motor according to claim 11, wherein the intake passage includes a throttle body including a throttle valve arranged to adjust a flow rate of air supplied to the engine, and the fuel injection device is arranged to inject fuel in a vicinity of the throttle body.

13. The outboard motor according to claim 12, wherein the engine includes a plurality of cylinders, and the intake passage further includes a plurality of intake pipes, first ends of which are connected to the throttle body and second ends of which are respectively connected to each of the plurality of cylinders.

14. The outboard motor according to claim 13, wherein the fuel injection device is the only fuel injection device provided and is connected to each of the plurality of intake pipes.

15. The outboard motor according to claim 12, wherein the fuel injection device is disposed downstream in the airflow direction relative to the throttle valve of the throttle body.

16. The outboard motor according to claim 12, wherein the fuel injection device is arranged to inject fuel toward the throttle valve.

17. The outboard motor according to claim 16, wherein the throttle valve includes a butterfly-type throttle valve.

18. The outboard motor according to claim 12, wherein the throttle body includes a main air passage in which the throttle valve is provided, and a bypass air passage arranged to connect an upstream side and a downstream side of the main air passage relative to the throttle valve, and the fuel injection device is arranged such that an injection nozzle of the fuel injection device is positioned in a vicinity of an air exit of the bypass air passage positioned downstream of the throttle valve.

19. The outboard motor according to claim 12, further comprising:

a fuel tank arranged to hold fuel to be supplied to the fuel injection device; and a fuel supply pump arranged to supply the fuel from the fuel tank to the fuel injection device; wherein the fuel tank is disposed adjacent to the throttle body.

20. The outboard motor according to claim 12, wherein the throttle body includes a main air passage in which the throttle valve is provided, and the fuel injection device is arranged to inject fuel obliquely relative to a vertical plane that is perpendicular to a direction in which the main air passage of the throttle body extends.

* * * * *